United States Patent [19]

Otake et al.

[11] 4,390,058

[45] Jun. 28, 1983

[54] METHOD OF MONITORING CONDENSER PERFORMANCE AND SYSTEM THEREFOR

[75] Inventors: Katsumoto Otake, Hitachi; Masahiko Miyai, Mito; Yasuteru Mukai; Isao Okouchi, both of Hitachi, all of Japan

[73] Assignee: Hitachi, Ltd., Tokyo, Japan

[21] Appl. No.: 213,095

[22] Filed: Dec. 4, 1980

[30] Foreign Application Priority Data

Dec. 5, 1979 [JP] Japan ..... 54-156907

[51] Int. Cl.[3] ..... F28G 13/00; F28F 27/00; F28B 9/00; F28B 11/00

[52] U.S. Cl. ..... 165/1; 165/11 R; 165/32; 165/95

[58] Field of Search ..... 165/95, 11 A, 1, 11 R, 165/32

[56] References Cited

U.S. PATENT DOCUMENTS

| | | | |
|---|---|---|---|
| 3,021,117 | 2/1962 | Taprogge | 165/95 |
| 3,312,274 | 4/1967 | Sebald | 165/11 R |
| 3,412,786 | 11/1968 | Taylor | 165/95 |
| 4,215,741 | 8/1980 | Averbuch et al. | 165/11 R |
| 4,293,853 | 10/1981 | Kubota | 165/11 R X |

FOREIGN PATENT DOCUMENTS

| | | | |
|---|---|---|---|
| 56-80692 | 7/1981 | Japan | 165/11 A |
| 636461 | 12/1978 | U.S.S.R. | 165/95 |

*Primary Examiner*—Sheldon J. Richter

*Attorney, Agent, or Firm*—Antonelli, Terry & Wands

[57] ABSTRACT

A method of monitoring the performance of a condenser and a system for carrying such method into practice, wherein a cooling water temperature, a cooling water flow rate, a condenser temperature and/or a heat flux through walls of cooling water tubes of the condenser are sensed by sensors to obtain values representing the operating conditions of the condenser, and an overall heat transmission coefficient or a heat transfer rate of the cooling water tubes is calculated at an arithmetic unit from the values representing the operating conditions. The cleanness of the cooling water tubes is calculated by an arithmetic unit from the value of the overall heat transmission coefficient or the heat transfer rate, and the performance of the condenser is judged by a performance judging unit based on the cleanness of the cooling water tubes.

32 Claims, 3 Drawing Figures

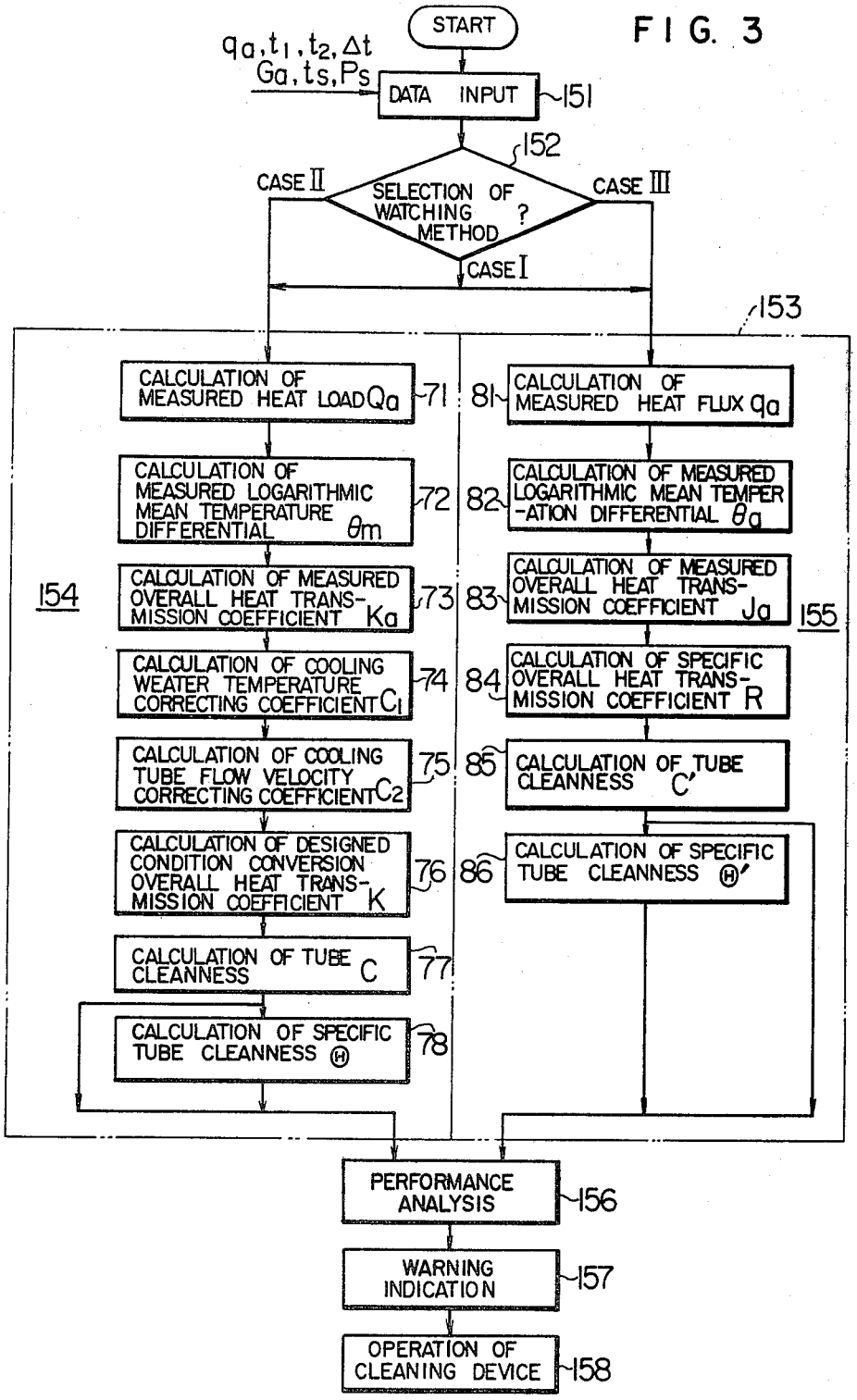
FIG. 3
START
qa, t1, t2, Δt
Ga, ts, Ps
DATA INPUT
151
152
SELECTION OF WATCHING METHOD ?
CASE II
CASE III
CASE I
153
154
155
CALCULATION OF MEASURED HEAT LOAD Qa
71
CALCULATION OF MEASURED LOGARITHMIC MEAN TEMPERATURE DIFFERENTIAL θm
72
CALCULATION OF MEASURED OVERALL HEAT TRANSMISSION COEFFICIENT Ka
73
CALCULATION OF COOLING WEATER TEMPERATURE CORRECTING COEFFICIENT C1
74
CALCULATION OF COOLING TUBE FLOW VELOCITY CORRECTING COEFFICIENT C2
75
CALCULATION OF DESIGNED CONDITION CONVERSION OVERALL HEAT TRANSMISSION COEFFICIENT K
76
CALCULATION OF TUBE CLEANNESS C
77
CALCULATION OF SPECIFIC TUBE CLEANNESS Ⓗ
78
81
CALCULATION OF MEASURED HEAT FLUX qa
82
CALCULATION OF MEASURED LOGARITHMIC MEAN TEMPERATION DIFFERENTIAL θa
83
CALCULATION OF MEASURED OVERALL HEAT TRANSMISSION COEFFICIENT Ja
84
CALCULATION OF SPECIFIC OVERALL HEAT TRANSMISSION COEFFICIENT R
85
CALCULATION OF TUBE CLEANNESS C'
86
CALCULATION OF SPECIFIC TUBE CLEANNESS Ⓗ'
PERFORMANCE ANALYSIS
156
WARNING INDICATION
157
OPERATION OF CLEANING DEVICE
158

METHOD OF MONITORING CONDENSER PERFORMANCE AND SYSTEM THEREFOR

BACKGROUND OF THE INVENTION

This invention relates to condensers for steam for driving turbines of fossil fuel power generating plants, and more particularly it is concerned with a method of monitoring the performance of a condenser of the type described and a system suitable for carrying such method into practice.

A method of the prior art for monitoring the performance of a condenser has generally consisted in sensing the operating conditions of the condenser (such as the vacuum in the condenser, inlet and outlet temperatures of the cooling water fed to and discharged from the condenser, discharge pressure of the circulating water pump for feeding cooling water, etc.), and recording the values representing the operating conditions of the condenser so that these values can be monitored individually.

The performance of a condenser is generally judged by the vacuum maintained therein, in view of the need to keep the back pressure of the turbine at a low constant level. Except for the introduction of air into the condenser, the main factor concerned in the reduction in the vacuum in the condenser is a reduction in the cleanness of the cooling water tubes. No method for monitoring the performance of a condenser based on the concept of quantitatively determining the cleanness of the condenser cooling water tubes or the degree of their contamination has yet to be developed.

SUMMARY OF THE INVENTION

An object of this invention is to develop a method of monitoring the performance of a condenser based on values representing the operating conditions of the condenser, so that accurate diagnosis of the performance of the condenser can be made.

Another object is to provide a system for monitoring the performance of a condenser based on values representing the operating conditions of the condenser, so that accurate diagnosis of the condenser can be made.

Still another object is to provide a method of monitoring the performance of a condenser based on values representing the operating conditions of the condenser and passing judgment as to whether or not the performance of the condenser is normal, and a system suitable for carrying such method into practice.

According to the invention, there is provided a method of monitoring the performance of a condenser comprising the steps of: obtaining values representing the operating conditions of the condenser, and monitoring the performance of the condenser based on the cleanness of cooling water tubes of the condenser determinined by calculating the obtained values.

According to the invention, there is provided a system for monitoring the performance of a condenser comprising: sensing means for sensing the operating conditions of the condenser to obtain values representing the operating conditions of the condenser, and arithmetic units for calculating the cleanness of cooling water tubes of the condenser based on the values obtained by the sensing means, to thereby make accurate diagnosis of the performance of the condenser.

BRIEF DESCRIPTION OF THE DRAWINGS

FIG. 3 is a flow chart showing the manner in which monitoring of the performance of the condenser is carried out according to the invention.

DESCRIPTION OF THE PREFERRED EMBODIMENT

Figure 1:
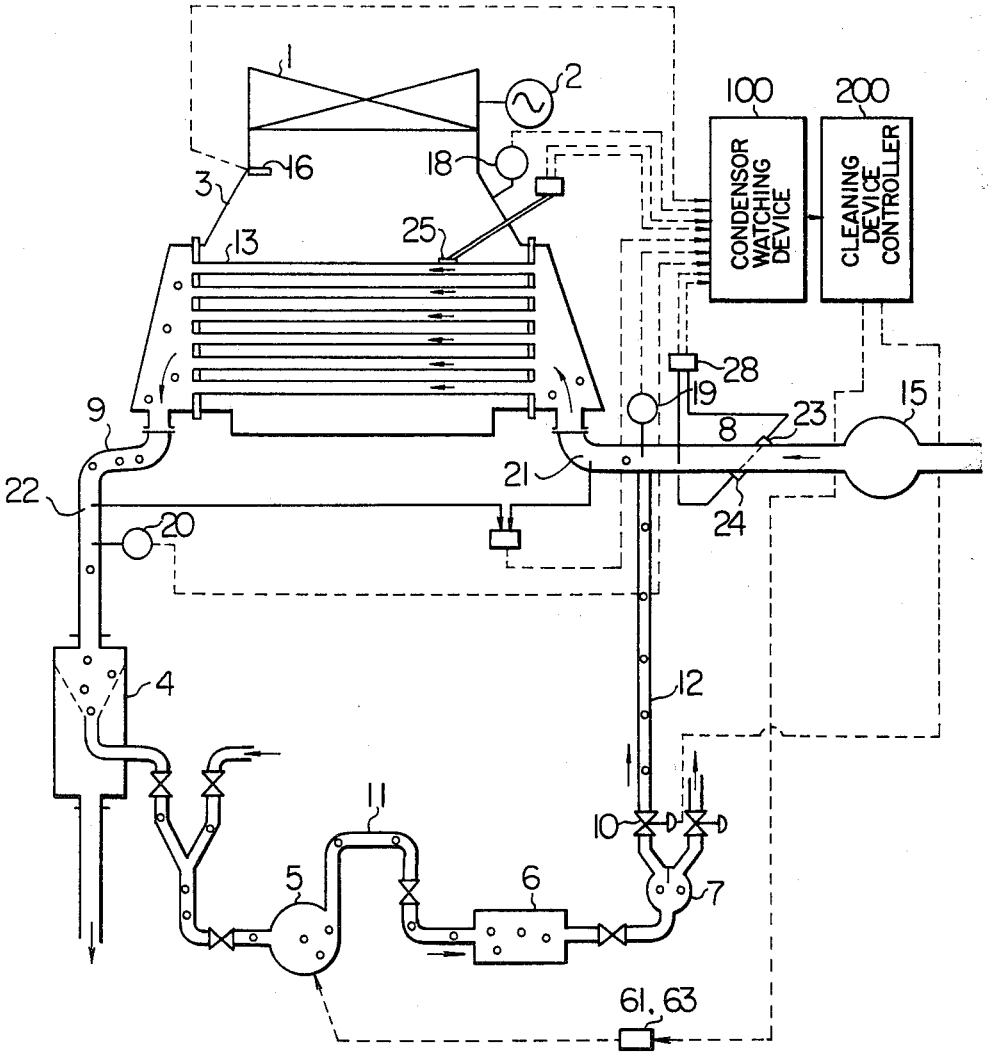
FIG. 1 is a systematic view of a condenser, in its entirety, for a steam turbine in which is incorporated the system for monitoring the performance of the condenser comprising one embodiment of the invention.

The invention will now be described by referring to a preferred embodiment shown in the accompanying drawings. In FIG. 1, a condenser 3 for condensing a working fluid in the form of steam for driving a turbine 1, which is in turn connected to drive a generator 2, includes a plurality of cooling tubes 13, and has connected thereto a cooling water inlet line 8 mounting therein a circulating water pump 15 for feeding cooling water and a cooling water outlet line 9 for discharging the cooling water from the condenser 3 after exchanging heat with the working fluid. Interposed between the cooling water inlet line 8 and the cooling water outlet line 9 is a condenser continuous cleaning device for circulating resilient spherical members 12 through the cooling water tubes 13 for cleaning same. The condenser continuous cleaning device comprises a spherical member catcher 4, a spherical member circulating pump 5, a spherical member collector 6, a spherical member distributor 7, a spherical member circulating line 11 and a spherical member admitting valve 10. The condenser continuous cleaning device of the aforesaid construction is operative to circulate the spherical members 12 through the cleaning water tubes 13 when need arises.

A pressure sensor 18 (See FIG. 2) is mounted on the shell of the condenser 3 for sensing the vacuum in the condenser 3. The cooling water inlet line 8 has mounted therein an inlet temperature sensor 19 and a temperature differential sensor 21, and the cooling water outlet line 9 has mounted therein an outlet temperature sensor 20 and another temperature differential sensor 22. Ultrasonic wave sensors 23 and 24 serving as ultrasonic wave flow meters are mounted on the surface of the cooling water inlet line 8 in juxtaposed relation, to detect the flow rate of the cooling water. The temperature differential sensor 21 mounted in the cooling water inlet line 8 and the temperature differential sensor 22 mounted in the cooling water outlet line 9 are mounted for the purpose of improving the accuracy with which the inlet temperature sensor 19 and the outlet temperature sensor 20 individually sense the respective temperatures. It is to be understood that the objects of the invention can be accomplished by eliminating the temperature differential sensors 21 and 22 and only using the temperature sensors 19 and 20.

A plurality of heat flow sensors 25 are mounted on the outer surfaces of the arbitrarily selected cooling water tubes 13. In place of the pressure sensor 18, a temperature sensor 16 for directly sensing the temperature of the steam in the condenser 3 may be used.

The pressure sensor 18, cooling water inlet and outlet temperature sensors 19 and 20, cooling water temperature differential sensors 21 and 22, ultrasonic wave sensors 23 and 24, temperature sensor 16 and heat flow sensors 25 produce outputs representing the detected values which are fed into a condenser monitoring device 100 operative to monitor the operating conditions of the condenser 3 based on the detected values and actuate a cleaning device controller 200 when a reduction in the performance of the condenser 3 is sensed, to clean the condenser 3.

Figure 2:
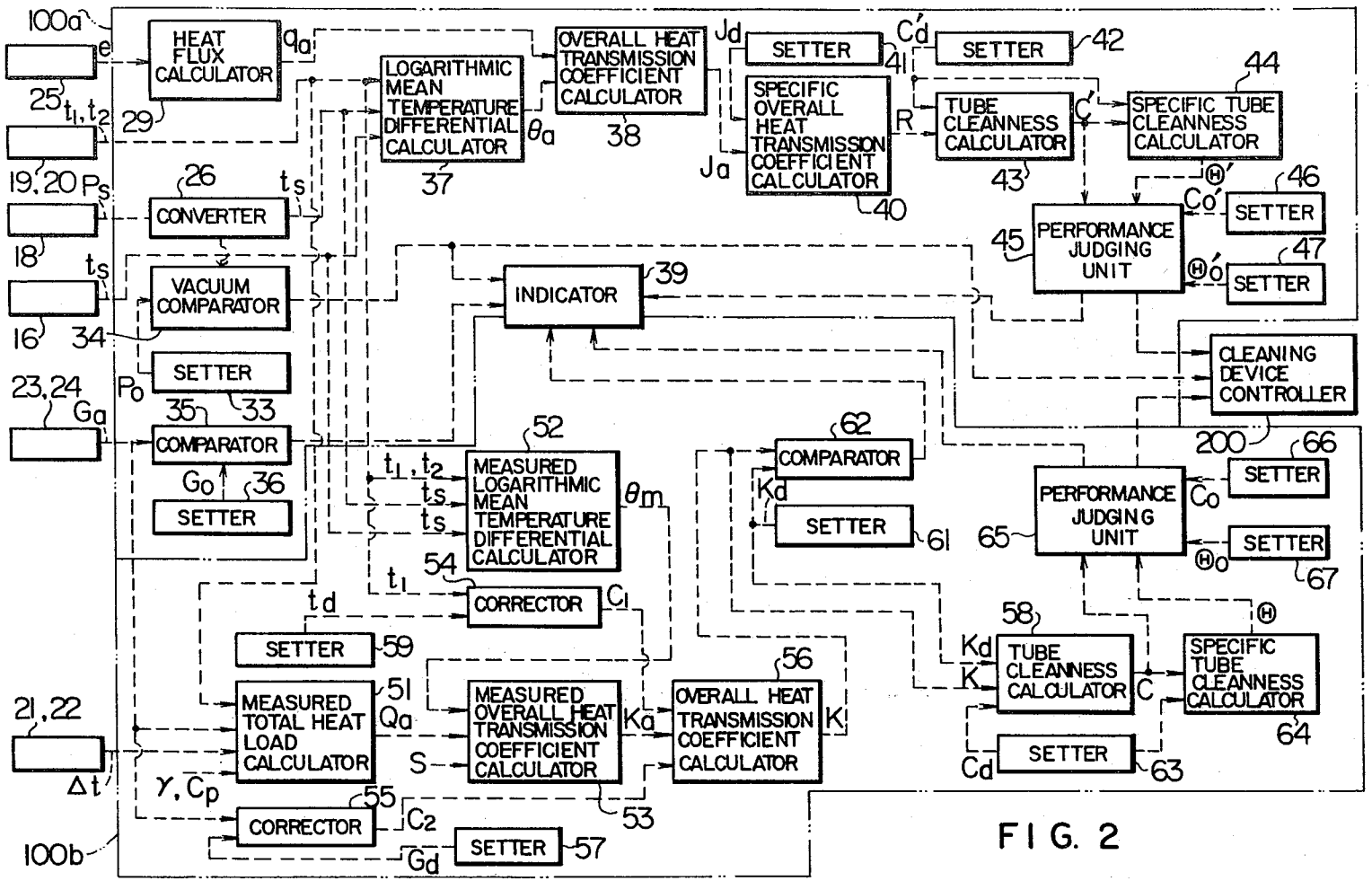
FIG. 2 is a block diagram showing in detail the system for monitoring the performance of the condenser shown in FIG. 1.

The detailed construction of the condenser monitoring device 100 for monitoring the operating conditions of the condenser 3 to determine whether or not the condenser 3 is functioning normally based on the values obtained by the sensors 18, 19, 20, 21, 22, 23, 24, 25 and 16 will be described by referring to a block diagram shown in FIG. 2. The condenser monitoring device 100 comprises a heat flux monitoring section 100*a* and an overall heat transmission coefficient monitoring section 100*b*. The heat flux monitoring section 100*a* will be first described. The heat flow sensors 25 mounted on the outer wall surfaces of the cooling water tubes 13 each produce an output signal e which is generally detected in the form of a mV voltage. The relation between the outputs e of the heat flow sensors 25 and a heat flux $q_a$ transferred through the walls of the cooling water tubes 13 can be expressed, in terms of a direct gradient K, by the following equation (1):

$$q_a \alpha K.e \tag{1}$$

Thus the transfer of the heat representing varying operating conditions can be readily detected. The measured heat flux $q_a$ is calculated from the inputs e based on the equation (1) at a heat flux calculator 29.

The pressure sensor 18 senses the vacuum in the condenser 3 and produces a condenser vacuum $p_s$. When the vacuum in the condenser 3 is sensed and the condenser vacuum $p_s$ is produced, a saturated temperature $t_s$ is obtained by conversion from the condenser vacuum $p_s$ at a converter 26. The condenser vacuum $p_s$ is compared with a set vacuum $p_o$ from a setter 33 at a vacuum comparator 34. When the condenser vacuum $p_s$ is found to be lower than the set vacuum $p_o$, an indicator 39 indicates that the condenser vacuum $p_s$ is reduced below the level of the value set at the setter 33. A condenser steam temperature $t_s$ may be directly sensed by the temperature sensor 16. The ultrasonic wave sensors 23 and 24 serving as ultrasonic wave flow meters produce a cooling water flow rate $G_a$ which is compared at a comparator 35 with a set cooling water flow rate $G_o$ from a setter 36. When the sensed flow rate of the cooling water is higher or lower than the level of the value set at the setter 36, the indicator 39 gives an indication to that effect. A cooling water inlet temperature $t_1$ and a cooling water outlet temperature $t_2$ from the sensors 19 and 20 respectively and the condenser steam temperature $t_s$ determined as aforesaid are fed into a logarithmic mean temperature differential calculator 37, to calculate a logarithmic mean temperature differential $\theta_m$ by the following equation (2):

$$\theta_m = \frac{t_2 - t_1}{l_n \frac{t_s - t_1}{t_s - t_2}} \tag{2}$$

In equation (2), the condenser steam temperature $t_s$ is directly obtained from the temperature sensor 16. However, the saturated temperature $t_s$ may be obtained by conversion from the condenser vacuum $p_s$ from the pressure sensor 18.

The heat flux $q_a$ calculated at the heat flux calculator 29 and the logarithmic mean temperature differential $\theta_m$ calculated at the logarithmic mean temperature differential calculator 37 are used to calculate at a heat transfer rate calculator 38 a heat transfer rate $J_a$ by the following equation (3):

$$J_a = q_a/\theta_m \tag{3}$$

A set heat transfer rate $J_d$ is calculated beforehand based on the operating conditions set beforehand at a heat transfer rate setter 41 or turbine lead, cooling water flow rate and cooling water inlet temperature as well as the specifications of the condenser 3, and the ratio of the heat transfer rate $J_a$ referred to hereinabove to the set heat transfer rate $J_d$ is obtained by the following equation (4):

$$R = J_a/J_d \tag{4}$$

The set heat transfer rate $J_d$ is obtained before the cooling water tubes 13 are contaminated. Thus any reduction in the performance due to the contamination of the cooling water tubes 13 can be sensed as $R<1$ in view of $J_a<J_d$. Therefore, the degree of contamination of the cooling water tubes 13 can be determined by equation (4). Now let us denote the tube cleanness at the time of planning by C'd which is fed to a setter 42. A tube cleanness C' during operation is calculated at a tube cleanness calculator 43 by the following equation (5):

$$C' = C_d.R \tag{5}$$

Then a specific tube cleanness $\theta'$ is calculated at a specific tube cleanness calculator 44 by the following equation (6):

$$\theta' = \frac{C_d - C'}{C_d} \tag{6}$$

Thus by watching the tube cleanness C' or specific tube cleanness $\theta'$, it is possible to determine the degree of contamination of the cooling water tubes 13 of the condenser 3. The heat flow sensors 25 mounted on the outer wall surfaces of the cooling water tubes 13 produce a plurality of values which may be processed at the heat flux calculator 29 to obtain a mean heat flux as an arithmetic mean by equation (1) or $q_a \alpha K.e$, so that the aforesaid calculations by equations (2), (3), (4), (5) and (6) can be done. To analyze the performance of the condenser 3, the tube cleanness C' and the specific tube cleanness $\theta'$ calculated at the calculators 43 and 44 respectively are compared with allowable values $C'_o$ and $\theta'_o$ set beforehand at setters 46 and 47 respectively, at a performance judging unit 45.

To enable the operator to promptly take necessary actions to cope with the situation based on the data analyzed at the performance judging unit 45, the presence of abnormality is indicated at the indicator 39 and a warning is issued when the tube cleanness C' or specific tube cleanness $\theta'$ is not within the tolerances, in the same manner as an indication is given when the condenser vacuum $p_s$ or cooling water flow rate $G_a$ is higher or lower than the level of value set beforehand, as described hereinabove. When the indication is given, the values obtained at the moment including the tolerances or changes occurring in chronological sequence in the value are also indicated. When the performance of the condenser 3 is judged to be abnormal by the performance judging unit 45, an abnormal performance signal produced by the performance judging unit 45 is supplied to the cleaning device controller 200 which makes a decision to actuate the cleaning device upon receipt of an abnormal vacuum signal from the vacuum comparator 34.

More specifically, assume that the condenser vacuum $p_s$ is lowered and this phenomenon is attributed to the tube cleanness C' and specific tube cleanness $\theta'$ not being within the tolerances by the result of analysis of the data by the performance judging unit 45. Then the cleaning device controller 200 immediately gives instructions to turn on the cleaning device, and an actuating signal is supplied to the spherical member circulating pump 15 and valve 10 shown in FIG. 1, thereby initiating cleaning of the cooling water tubes 13 by means of the resilient spherical members 12. The heat flux watching section 100*a* of the condenser watching device 100 is constructed as described hereinabove.

The overall heat transmission coefficient watching section 100*b* of the condenser watching device 100 will now be described. In FIG. 2, a measured total heat load $Q_a$ is calculated at a measured total heat load calculator 51. The total heat load $Q_a$ is calculated from the cooling water flow rate $G_a$ based on the inputs from the ultrasonic wave sensors 23 and 24, a temperature differential $\Delta t$ based on the inputs from the cooling water inlet and outlet temperature sensors 19 and 20 or the cooling water temperature differential sensors 21 and 22, a cooling water specific weight $\gamma$, and a cooling water specific heat $C_p$ by the following equation (7):

$$\begin{aligned} Q_a &= G_a(t_2 - t_1) \cdot \gamma \cdot C_p \\ &= G_a \cdot \Delta t \cdot \gamma \cdot C_p \end{aligned} \tag{7}$$

Then a measured logarithmic mean temperature differential $\theta_m$ is measured at a measured logarithmic mean temperature differential calculator 52. The calculation is done on the condenser saturated temperature $t_s$ corresponding to a corrected vacuum obtained by correcting the measured vacuum $p_s$ from the condenser pressure sensor 18 by atmospheric pressure, and the inlet temperature $t_1$ and outlet temperature $t_2$ from the cooling water inlet and outlet temperature sensors 19 and 20, by the following equation (8):

$$\theta_m = \frac{t_2 - t_1}{l_n \dfrac{t_s - t_1}{t_s - t_2}} \tag{8}$$

Then a measured overall heat transmission coefficient $K_a$ is calculated at a measured overall heat transmission coefficient calculator 53. The measured overall heat transmission coefficient $K_a$ is determined based on the total heat load $Q_a$ calculated at the measured total heat load calculator 51, the measured logarithmic mean temperature differential $\theta_m$ calculated at the measured logarithmic mean temperature differential calculator 52 and a condenser cooling water surface area S, by the following equation (9):

$$K_a = \frac{Q_a}{S \cdot \theta_m} \tag{9}$$

At a corrector 54, a cooling water temperature correcting coefficient $c_1$ is calculated. This coefficient is a correcting coefficient for the cooling water inlet temperature $t_1$ which is calculated from the ratio of a function $\phi_1 d$ of a designed value $t_d$ from a setter 59 to a function $\phi_1 a$ of a measured value $t_s$, by the following equation (10):

$$c_1 = \frac{\phi_1 d}{\phi_1 a} \tag{10}$$

Then a cooling water flow velocity correcting coefficient $c_2$ is calculated at another corrector 55. This coefficient is calculated from the square root of the ratio of a designed cooling water flow velocity $v_d$ to a measured cooling water flow velocity $v_a$ or the ratio of a designed cooling water flow rate $G_d$ to a measured cooling water flow rate $G_a$, by the following equation (11):

$$c_2 = \sqrt{\frac{V_d}{V_a}} = \sqrt{\frac{G_a}{G_d}} \tag{11}$$

Then a corrected overall heat transmission coefficient converted to a designed condition is calculated at an overall heat transmission coefficient calculator 56. The corrected overall heat transmission coefficient is calculated from the measured overall heat transmission coefficient $K_a$, the cooling water temperature correcting coefficient $c_1$ which is a correcting coefficient representing a change in operating condition, and a cooling water flow velocity correcting coefficient $c_2$ by the following equation (12):

$$K = K_a \cdot c_1 \cdot c_2 \tag{12}$$

A reduction in the performance of the condenser 3 due to contamination of the cooling water tubes 13 can be checked by comparing the corrected overall heat transmission coefficient K with a designed overall heat transmission coefficient $k_d$ from a setter 61, at another comparator 62.

Then a cooling water tube cleanness C is calculated at a tube cleanness calculator 58. The cooling water tube cleanness C is calculated from the corrected overall heat transmission coefficient K, the designed overall heat transmission coefficient $K_d$ fed as input data, and a designed cooling water tube cleanness $c_d$ from a setter 63, by the following equation (13) to obtain the tube cleanness C determined by comparison of the measured value with the designed value:

$$C = c_d \cdot \frac{K}{K_d} \tag{13}$$

Then a specific tube cleanness $\theta$ is calculated at a specific tube cleanness calculator 64 from the tube cleanness C obtained at the calculator 58 and the tube cleanness $c_d$ determined at the time of planning, by the following equation (14):

$$\theta = \frac{c_d - c}{c_d} \quad (14)$$

To analyze the performance of the condenser 3, the tube cleanness C and the specific tube cleanness $\theta$ calculated at the calculators 58 and 64 respectively are selectively compared at a performance judging unit 65 with allowable values $C_o$ and $\theta_o$ set at setters 66 and 67 respectively beforehand. In the same manner as described by referring to the heat flux watching section 100*a*, the presence of an abnormality in the operating conditions of the condenser 3 is indicated by the indicator 39 when the tube cleanness C and the specific tube cleanness $\theta$ are not within the tolerances, and the values obtained are also indicated. When the condenser 3 is judged to be abnormal in performance by the performance judging unit 65, an actuating signal is supplied to the cleaning device controller 200 from the judging unit 65 to actuate the cleaning device, to thereby clean the condenser cooling water tubes 13 by means of the resilient spherical members 12.

The operation of the system for monitoring the performance of the condenser 3 described hereinabove will now be described by referring to a flow chart shown in FIG. 3. A computer program for doing calculations for the system for monitoring the performance of the condenser 3 includes the specifications of the condenser, such as the cooling area S, cooling water tube dimensions (outer diameter, thickness, etc.) and the number of material of the cooling water tubes, and the standard designed values, such as total heat load $Q_a$, designed condenser vacuum $p_o$, designed cooling water flow rate $G_a$, designed overall heat transmission coefficient K or tube cleanness C and specific tube cleanness $\theta$, cooling water flow velocity, cooling water loss head, etc.

First of all, the monitoring routine is started and data input is performed at a step 151. The data includes the condenser pressure $p_s$ from the pressure sensor 18, the condenser temperature $t_s$ from the temperature sensor 16, the temperatures $t_1$ and $t_2$ from the cooling water inlet and outlet temperature sensors 19 and 20 respectively, the temperature differential $\Delta t$ from the cooling water temperature differential sensors 21 and 22, the cooling water flow rate $G_a$ from the ultrasonic wave sensors 23 and 24, and cooling water tube outer wall surface heat load $q_a$, as well as various operating conditions. By feeding this data into the computer, the step of data input of the monitoring routine is completed.

At a step 152, selection of the method for monitoring the performance of the condenser 3 is carried out. The method available for use in monitoring the performance of the condenser 3 includes the following three methods: a method relying on the amount of heat based on the cooling water wherein the overall heat transmission coefficient and the cooling water tube cleanness are measured as indicated at 154 (hereinafter referred to as overall heat transmission coefficient monitoring); a method relying on the amount of heat based on the steam wherein the heat flux is measured as indicated at 155 (hereinafter referred to as heat flux monitoring); and a method wherein the aforesaid two methods are combined with each other. At step 152, one of the following three cases is selected:

Case I: the overall heat transmission coefficient monitoring 154 and the heat flux monitoring 155 are both performed, and the results obtained are compared to enable the performance of the condenser 3 to be analyzed;

Case II: the overall heat transmission coefficient monitoring 154 is performed to analyze the performance of the condenser 3 based on the result achieved: and Case III: the heat flux monitoring 155 is performed to analyze the performance of the condenser 3 based on the result achieved.

The steps followed in carrying out the overall heat transmission coefficient monitoring 154 and the heat flux monitoring 155 are described as indicated at 153.

When the monitoring routine is started, the computer is usually programmed to carry out case I and select either one of cases II and III when need arises.

The overall heat transmission coefficient monitoring 154 will first be described. This monitoring operation is carried out by using the overall heat transmission watching section 100*b* shown in FIG. 2. In calculating the measured heat load in a step 71, the measured heat load $Q_a$ is calculated at the measured total heat load calculator 51 from the cooling water temperatures $t_1$ and $t_2$ and cooling water flow rate $G_a$. In calculating the measured logarithmic mean temperature differential $\theta_m$ in a step 72, the calculation is done from the cooling water temperatures $t_1$ and $t_2$ and the condenser temperature $t_s$ at the measured logarithmic mean temperature differential calculator 52. In a step 73, the measured overall heat transmission coefficient $K_a$ is calculated from the measured heat load $Q_a$, the measured logarithmic mean temperature differential $\theta_m$ and the cooling surface area S of the condenser 3 at the measured overall heat transmission coefficient calculator 53. Following the calculation of the cooling water temperature correcting coefficient $c_1$ in a step 74 and the calculation of the cooling water flow velocity correcting coefficient $c_2$ in a step 75, the designed state conversion overall heat transmission coefficient K is calculated from the measured overall heat transmission coefficient Ka, the cooling water temperature correcting coefficient $c_1$ and the cooling water flow velocity correcting coefficient $c_2$ at the overall heat transmission coefficient calculator 56 in a step 76. In a step 77, the tube cleanness C is calculated from the designed state conversion overall heat transmission coefficient K, the designed overall heat transmission coefficient $K_d$ and the designed cooling water tube cleanness $C_d$ at the tube cleanness calculator 68. In a step 78, the specific tube cleanness $\theta$ is calculated from the tube cleanness C and the designed tube cleanness $C_d$ at the specific tube cleanness calculator 64. The values of tube cleanness C and specific tube cleanness $\theta$ is analyzed in the step of performance analysis 156. When the performance of the condenser 3 is judged to be reduced, a warning is given in a step 157 and the cleaning device is actuated in a step 158, so as to restore the performance of the condenser 3 to the normal level.

The heat flux monitoring 155 will now be described. This monitoring operation is carried out by using the heat flux monitoring section 100*a* shown in FIG. 2. In a step 81, the measured heat flux $q_a$ is calculated from the outputs of the heat flow sensors 25 at the heat flux calculator 29. Then in a step 82, the measured logarithmic mean temperature differential $\theta_m$ is calculated from the cooling water temperatures $t_1$ and $t_2$ and the condenser temperature $t_s$ at the logarithmic mean temperature differential calculator 37. In a step 83, the measured heat transfer rate $J_a$ is calculated from the measured heat flux $q_a$ and the measured logarithmic mean temperature differential $\theta_m$ at the heat transfer rate calculator 38. In a step 84, the specific heat transfer rate R is calculated from the measured heat transfer rate $J_a$ and the designed heat transfer rate $J_d$ at the specific heat transfer rate calculator 40. In a step 85, the tube cleanness C' is calculated from the specific heat transfer rate R and the designed tube cleanness $C'_d$ at the tube cleanness calculator 43. From the tube cleanness C' and the designed tube cleanness $C'_d$, the specific tube cleanness $\theta'$ of the cooling water tubes 13 is calculated at the specific tube cleanness calculator 44. The values of tube cleanness C' and specific tube cleanness $\theta'$ obtained in this way are judged in the performance judging step 156 in the same manner as the overall heat transmission coefficient monitoring 154 is carried out. When it is judged that the performance of the condenser 3 is reduced, a warning is given in step 157 and the cleaning device is actuated in step 158, so as to restore the performance to the normal level. In the performance analyzing step 156, the tube cleanness C and specific tube cleanness $\theta$ obtained in the overall heat transmission coefficient monitoring 154 and the tube cleanness C' and specific tube cleanness $\theta'$ obtained in the heat flux watching 155 may be compared, to judge the performance of the condenser 3.

From the foregoing description, it will be appreciated that in the system for watching the performance of a condenser according to the invention, the cooling water inlet and outlet temperatures $t_1$ and $t_2$ or the cooling water temperature differential $\Delta t$, condenser temperature $t_2$, condenser vacuum $p_s$, cooling water flow rate $G_a$ and the flow flux of the cooling water tubes are measured by sensors, and the tube cleanness is watched by calculating the overall heat transmission coefficient of the cooling water tubes of the condenser and also by calculating the heat flux of the cooling water tubes of the condenser. By virtue of these two functions, the condenser performance monitoring system can achieve the following results:

(1) It is possible to monitor the performance of the condenser by following the operating conditions (load variations, cooling water inlet temperature, etc.);

(2) Monitoring of the condenser performance can be carried out at all times for judging the cleanness of the cooling water tubes with respect to the vacuum in the condenser;

(3) Cleaning of the condenser cooling water tubes can be performed continuously while grasping the cleanness of the cooling water tubes, thereby enabling the performance of the condenser to be kept at a high level at all times; and (4) Combined with the overall heat transmission monitoring, the heat flux monitoring enables the monitoring of the performance of the condenser to be carried out with a high degree of accuracy.

It is to be understood that the art of monitoring the performance of a condenser according to the invention can also have application in other heat exchangers of the tube system than condensers in which contamination of the cooling water tubes causes abnormality in their performances.

From the foregoing description, it will be appreciated that the method of and system for monitoring the performance of a condenser provided by the invention enables assessment of the performance of a condenser to be effected by determining the operating conditions of the condenser and processing the values obtained by arithmetical operation.

What is claimed is:

1. A method of monitoring the performance of a condenser comprising the steps of:

sensing the operating conditions of the condenser and obtaining values representing the operating conditions;

calculating the cleanness of cooling water tubes of the condenser based on at least one of the variables of the overall condenser heat transmission coefficient and a heat transfer rate according to the values obtained in the first step; and controlling the performance of the condenser with special reference to the values representing the cleanness of the cooling water tubes.

2. A method as set forth in claim 1, wherein values of cooling water temperature, cooling water flow rate and steam temperature in the condenser are sensed as representing the operating conditions of the condenser, and the cleanness of the cooling water tubes is calculated from an overall heat transmission coefficient of the cooling water tubes calculated from the obtained values representing the operating conditions of the condenser.

3. A method as set forth in claim 2, wherein a total heat load is calculated from the cooling water temperature and the cooling water flow rate and a logarithmic mean temperature differential is calculated from the cooling water temperature and the steam temperature in the condenser, and the overall heat transmission coefficient is calculated from the total heat load and the logarithmic mean temperature differential.

4. A method as set forth in claim 2, wherein the performance of the condenser is controlled based on the value of the overall heat transmission coefficient or the cleanness of the cooling water tubes.

5. A method as set forth in claim 4, wherein the step of controlling the performance of the condenser includes effecting cleaning of the cooling water tubes of the condenser.

6. A method as set forth in claim 1, wherein values of cooling water temperature, steam temperature in the condenser and heat flow through walls of the cooling water tubes are sensed as representing the operating conditions of the condenser, and the cleanness of the cooling water tubes is calculated from a heat flux and a heat transfer rate calculated from the obtained values representing the operating conditions of the condenser.

7. A method as set forth in claim 3, wherein the heat flux is calculated from the heat flow through the walls of the cooling water tubes and a logarithmic mean temperature differential is calculated from the cooling water temperature and the steam temperature in the condenser, and the cleanness of the cooling water tubes is calculated from the heat transfer rate calculated from the heat flux and the logarithmic mean temperature differential.

8. A method as set forth in claim 6, wherein the performance of the condenser is judged based on the value of the cleanness of the cooling water tubes.

9. A method as set forth in claim 8, wherein the step of controlling the performance of the condenser includes effecting cleaning of the cooling water tubes of the condenser.

10. A method of monitoring the performance of a condenser having a plurality of cooling tubes, comprising the steps of:

(i) sensing the inlet and outlet temperatures and the flow rate of the cooling water supplied into the condenser while sensing steam pressure or stem temperature in the condenser;

(ii) calculating the total heat load of the total cooling water tubes based on the inlet and outlet temperatures and the flow rate of the cooling water respectively obtained in the first step;

(iii) calculating the overall heat transmission coefficient of the total cooling water tubes based on said total heat load and said sensed values;

(iv) calculating the cleanness of the cooling water tubes of the condenser based on said overall heat transmission coefficient; and (v) controlling the performance of the condenser based on the values representing the cleanness of the total cooling water tubes.

11. A method as set forth in claim 10, comprising the steps of:

(i) calculating the logarithmic mean temperature differential of the total cooling water tubes based on the sensed inlet and outlet temperatures and the steam pressure or steam temperature in the condenser; and (ii) calculating said overall heat transmission coefficient based on said total heat load and said logarithmic mean temperature differential.

12. A method as set forth in claim 10, wherein the step of controlling the performance of the condenser includes effecting cleaning of the cooling water tubes of the condenser.

13. A method of monitoring the performance of a condenser comprising the steps of:

(i) sensing the value of the heat flow of the cooling water tubes transmitted through the walls of the cooling water tubes of the condenser, and sensing the inlet and outlet temperatures of the cooling water flowing in the cooling water tubes of the condenser, the cooling water flow rate and a steam pressure or steam temperature in the condenser;

(ii) calculating the heat flux based on the values of the sensed heat flow of the cooling water tubes;

(iii) calculating the heat transfer rate of the cooling water tubes based on said heat flux value and said sensed values;

(iv) calculating the cleanness of the cooling water tubes of the condenser based on said heat transfer rate of the cooling water tubes; and (v) controlling the performance of the condenser based on the values representing the cleanness of the cooling water tubes of the condenser.

14. A method as set forth in claim 13, comprising the steps of:

(i) calculating the logarithmic mean temperature differential based on the sensed inlet and outlet temperatures of the cooling water and the steam pressure or steam temperature in the condenser; and (ii) calculating the heat transfer rate based on said heat flux and the logarithmic mean temperature differential.

15. A method as set forth in claim 13, wherein the step of controlling the performance of the condenser includes effecting cleaning of the cooling water tubes of the condenser.

16. A system for monitoring the performance of a condenser, comprising:

a plurality of sensors for sensing the operating conditions of the condenser and for generating signals having values representing said operating conditions including cooling water temperature sensors and means including a condenser steam temperature sensor or condenser steam pressure sensor; and a monitoring device connected to said sensors and comprising first arithmetic means for calculating the overall condenser heat transmission coefficient which is a measure of the cleanness of cooling water tubes of the condenser based on signals from said sensors representing the variables of a least one of heat flux and heat transfer rate according to the values representing the operating conditions obtained by said sensors, to thereby monitor the performance of the condenser.

17. A system as set forth in claim 16, wherein said plurality of sensors further include cooling water flow rate sensors, and said monitoring device further comprises second arithmetic means for calculating an overall heat transmission coefficient necessary for determining the cleanness of the cooling water tubes calculated from values representing the operating conditions obtained by said sensors.

18. A system as set forth in claim 17, wherein said monitoring device further comprises third arithmetic means for calculating a total heat load from values obtained by said cooling water temperature sensors and said cooling water flow rate sensors, and fourth arithmetic means for calculating a logarithmic mean temperature differential from values obtained by said cooling water temperature detectors and means including said condenser steam temperature sensor or said condenser steam pressure sensor, and wherein the overall heat transmission coefficient is calculated at said second arithmetic means from values obtained by calculations done at said third and fourth arithmetic means.

19. A system as set forth in claim 17, wherein said monitoring device further comprises performance judging means for judging the performance of the condenser based on the cleanness of the cooling water tubes determined by said first arithmetic means and the overall heat transmission coefficient determined by said second arithmetic means.

20. A system as set forth in claim 19, further comprising a cleaning device for cleaning the cooling water tubes of the condenser by means of resilient spherical members introduced into said cooling water tubes, and a controller for actuating said cleaning device by an actuating signal supplied by said performance judging means.

21. A system as set forth in claim 16, wherein said plurality of sensors comprise further include sensors for detecting heat flows through walls of the cooling water tubes, and said monitoring device further comprises second arithmetic means for calculating the heat flux necessary for determining the cleanness of the cooling water tubes calculated from values representing the operating conditions obtained by said sensors, and third arithmetic means for calculating the heat transfer rate necessary for determining the cleanness of the cooling water tubes calculated from the values representing the operating conditions obtained by said sensors.

22. A system as set forth in claim 21, wherein said monitoring device further comprises a fourth arithmetic unit for calculating a logarithmic mean temperature differential from values obtained by said cooling water temperature sensors, said condenser steam temperature sensor or said condenser steam pressure sensor, and the heat transfer rate is calculated at said third arithmetic means from values obtained by calculations done at said second arithmetic means and said fourth arithmetic means.

23. A system as set forth in claim 21, wherein said monitoring device further comprises another performance judging means for judging the performance of the condenser based on the cleanness of the cooling water tubes determined by said first arithmetic means.

24. A system as set forth in claim 23, further comprising a cleaning device for cleaning the cooling water tubes of the condenser by means of resilient spherical members introduced into said cooling water tubes, and a controller for actuating said cleaning device by an actuating signal supplied by said another performance judging means.

25. A system for monitoring the performance of a condenser comprising:

means including a plurality of cooling water temperature sensors for respectively sensing the inlet temperature and the outlet temperature of the cooling water supplied in the condenser having cooling water tubes, cooling water flow rate sensor means for sensing the flow rate of said cooling water, a condenser steam temperature sensor or condenser steam pressure sensor, and total heart load calculating means for calculating the total heat load of the total cooling water tubes of the condenser based on the values obtained by said cooling water temperature sensors and the cooling water flow rate sensor means;

overall heat transmission coefficient calculating means for calculating the overall heat transmission coefficient of the total cooling water tubes of the condenser based on the total heat load of the total cooling tubes calculated by said total heat load calculating means and the values obtained by said plurality of sensors; and tube cleanness calculating means for calculating the cleanness of the total cooling water tubes based on the overall heat transmission coefficient obtained by said overall heat transmission coefficient calculating means.

26. A system as set forth in claim 25, further comprising logarithmic mean temperature differential calculating means for calculating the logarithmic mean temperature differential of the total cooling water tubes based on the values obtained by said cooling water temperature sensors and the condenser steam pressure sensor or the condenser steam temperature sensors; whereby said overall heat transmission coefficient calculating means is capable of calculating the overall heat transmission coefficient based on the values representing the total heat load obtained by the total heat load calculating means and the logarithmic mean temperature differential obtained by said logarithmic mean temperature differential calculating means.

27. A system as set forth in claim 25, comprising performance judging means for judging the performance of the condenser based on the tube cleanness determined by said tube cleanness calculating means.

28. A system as set forth in claim 25, further comprising a cleaning device for cleaning the cooling water tubes of the condenser by means of resilient spherical members introduced into said cooling water tubes, and a controller for actuating said cleaning device by an actuating signal supplied by said performance judging means.

29. A system for monitoring the performance of a condenser comprising:

heat flow sensor means provided on the cooling water tubes of the condenser for sensing the heat flow transmitted through walls of the cooling water tubes, means including a plurality of cooling water temperature sensors for respectively sensing the inlet and outlet temperatures of the cooling water flowing through the cooling water tubes of the condenser, flow rate sensor means for sensing the flow rate of said cooling water, means including a steam pressure or steam temperature sensor for sensing the steam pressure of the steam temperature in the condenser;

heat flux calculating means for calculating the heat flux of the cooling water tubes based on the value of the heat flow determined by said heat flow sensor means;

heat transfer rate calculating means for calculating the heat transfer rate of the cooling water tubes based on the values obtained by said plurality of sensors; and tube cleanness calculating means for calculating the tube cleanness based on the heat transfer rate obtained by said heat transfer rate calculating means.

30. A system as set forth in claim 29, further comprising a logarithmic mean temperature differential calculating means for calculating the logarithmic mean temperature differential of the cooling water tubes based on the values obtained by said cooling water temperature sensors and the condenser steam pressure or condenser steam temperature sensors, whereby said heat transfer rate calculating means is capable of calculating the heat transfer rate based on the heat flux obtained by said heat flux calculating means and the logarithmic means temperature differential obtained by said logarithmic means temperature differential calculating means.

31. A system as set forth in claim 29, comprising performance judging means for judging the performance of the condenser based on the tube cleanness determined by said tube cleanness calculating means.

32. A system as set forth in claim 31, comprising a cleaning device for cleaning the cooling water tubes by introducing cleaning medium into the cooling water tubes of the condenser based on the actuating signal from the performance judging means.

* * * * *